United States Patent [19]

Sanborn

[11] Patent Number: 4,561,201

[45] Date of Patent: Dec. 31, 1985

[54] METHOD AND APPARATUS FOR SKY TYPING

[76] Inventor: George A. Sanborn, 19210 NE. Clackamas St., Portland, Oreg. 97230

[21] Appl. No.: 637,508

[22] Filed: Aug. 3, 1984

[51] Int. Cl.[4] ..... G09F 21/16

[52] U.S. Cl. ..... 40/213; 252/305

[58] Field of Search ..... 40/213; 252/305

[56] References Cited

U.S. PATENT DOCUMENTS

| | | | |
|---|---|---|---|
| 1,716,794 | 6/1929 | Remey | 40/213 |
| 2,062,511 | 12/1936 | Haddock et al. | 40/213 |
| 2,065,024 | 12/1936 | Remey | 40/213 |
| 2,308,060 | 1/1943 | DeRochefort-Lucay | 40/213 |
| 2,563,621 | 8/1951 | Ritchie | 252/305 |
| 3,089,271 | 5/1963 | Copeland | 40/213 |
| 4,122,618 | 10/1978 | Gay | 40/213 |

*Primary Examiner*—John J. Wilson
*Assistant Examiner*—Cary E. Stone
*Attorney, Agent, or Firm*—Oliver D. Olson

[57] ABSTRACT

Advertising in the sky is produced by a plurality of fog emitting nozzles, for example each at the outlet of a canister containing fog producing material under pressure, which canisters are supported in spaced apart relation along a length of a winch line cable suspended from an aircraft. Each nozzle is controlled by a solenoid valve, the solenoid of which is activated on a timed schedule predetermined to contribute to the production of one or more letters, numerals, and/or designs in the sky in the creation of advertising material.

7 Claims, 4 Drawing Figures

METHOD AND APPARATUS FOR SKY TYPING

BACKGROUND OF THE INVENTION

This invention relates to sky writing apparatus and methods, and more particularly to a novel sky writing apparatus and method which permits a single airplane to effectively print in the sky letters, words, numbers and designs the printing of which previously required the coordinated efforts of five sky writing airplanes flying in formation.

Sky writing is an art that has been known for many years, and continues to find much popularity in advertising and publicity campaigns. Traditionally, the art comprises two basic forms of writing performed by two different methods, the first and most common method being that a highly skilled flyer in a plane equipped to dispense fog material behind it will literally maneuver his airplane aerobatically to form letters and words in script fashion, the plane essentially acting much like a pencil does on paper.

The second basic form of sky writing, now becoming particularly popular, is sky typing, in which individual, highly recognizable letters form words in the sky. This method involves precision flying by a team of usually five fog emitting planes flying together in formation to form letters and characters of block configuration similar to the characters printed by a typewriter. Each member of the team flies a specific course and direction parallel to one another and emit fog in proper position on a $5\times5$ matrix to form one horizontal part or leg of a letter. His companions, doing their part of the assignment, each forms another horizontal part or leg, and so forth until the letter is completed. Then, the next letter is formed, and on until the word or phrase is completed. Each plane will complete the appropriate legs of successive letters in similar fashion. Therefore a plurality of planes are required to form each letter of each word to be written.

Although sky typing is especially desirable for its highly recognizable lettering, understandably the expense is often prohibitive, as the art requires five specialized planes and highly proficient pilots for each job. Alertness, constant radio contact, pre flight planning and total adherence to individual flight paths are absolute essentials to effectiveness and safety whenever this group of planes work so closely together in such small air space. Special piloting skills are absolutely mandatory, and just as clearly the resulting advertising costs to the customer are correspondingly high.

Another important feature involved in the art of sky writing is the commercial use of fogging agents designed to create streams or puffs of "smoke" in the air. Most often, chemicals are used which react with the moisture in the air to form white oxides, which tend to remain visible for periods of time.

A conventional fogging chemical that is preferred today is titanium tetrachloride, (TiCL4) a liquid which, when atomized and dispersed into the atmosphere, reacts with the moisture in the air and forming a visible titanium oxide. This reaction product is especially white and makes an excellent lettering "smoke".

Traditionally, canisters containing titanium tetrachloride are pressurized with compressed air, which acts as a propellant and carrier to dispense the chemical when a valve is opened. Inherently, as the chemical escapes from the nozzle of the canister when the valve is opened, salts begin to form and very often plug up the nozzle, causing mis-firing, a sticking valve, or failure of the material to dispense further.

SUMMARY OF THE INVENTION

In its basic concept, this invention provides a novel apparatus arranged to sky type letters and designs in the air using only one airplane and a method of accomplishing the sky typing using a matrix printing system which allows the single airplane to fly in a single, level flight path while complete letters and designs are quickly formed therebehind.

It is by virtue of the foregoing basic concept that the principal objective of this invention is achieved; namely to overcome the disadvantages and limitations of sky writing and sky typing of the prior art.

Another object of this invention is the provision of sky typing apparatus and method of the class described which significantly reduces the instance of failure of the system to dispense fog material from the canisters.

Another object of this invention is the provision of sky typing apparatus of the class described which completely eliminates the necessity of using costly, highly specialized pilots and airplanes to accomplish sky typing advertising.

Another object of this invention is the provision of sky typing apparatus and method of the class described which avoids the use of multiple, coordinating airplanes in the same airspace to form individual letters, words and designs in the sky.

Another object of this invention is the provision of sky typing apparatus and method of the class described that utilizes an onboard computer which accounts for air speed and other variables and controls the dispensing of fog material automatically from a plurality of vertically spaced apart canisters depending downwardly from the airplane.

A further object of this invention is the provision of sky typing apparatus and method of the class described which is of simplified construction for economical manufacture and use and which dramatically reduces the operational costs of sky writing advertising.

The foregoing and other objects and advantages of this invention will appear from the following detailed description, taken in connection with the accompanying drawings of a preferred embodiment.

DESCRIPTION OF THE PREFERRED EMBODIMENT

Figure 1:
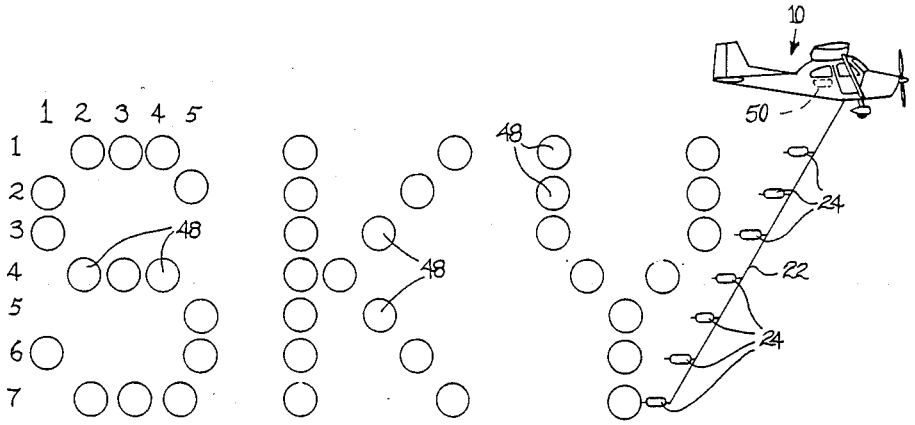
FIG. 1 is side elevation in schematic form of sky writing apparatus embodying the features of this invention suspended from an airplane forming letters of spaced apart puffs of "smoke" therebehind.
Figure 2:
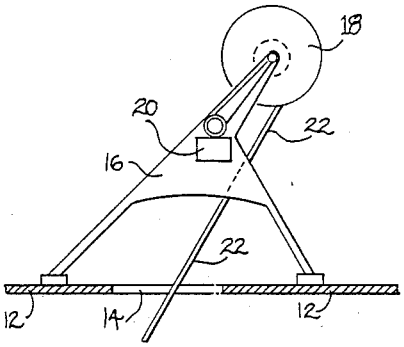
FIG. 2 is a fragmentary side elevation of a winch assembly disposed in an airplane, the canister supporting cable extending through an opening in the bottom of the airplane.

An airplane 10, such as the one illustrated in FIG. 1 has a bottom fuselage wall 12 (FIG. 2) provided with an opening 14 therethrough. Winch means, illustrated herein as base stand 16 rotatably mounting a cable receiving drum 18 and a winch motor 20, is secured to the fuselage wall 12 above the opening 14 so that winch line 22 may extend from the drum 18 and downwardly through the fuselage opening. In the embodiment illustrated in FIG. 2, the drum of the winch is positioned slightly forwardly of the opening, so that the lowered winch line, subject to the rearward rush of wind as the plane flies forwardly through the air, is allowed to extend angularly, as shown in FIG. 1, preferably without being obstructed by the fuselage and also allowing room for canisters attached to the line to be passed through the opening during winching.

In the embodiment illustrated, a plurality of individual chemical containing canisters 24 are positioned at regularly spaced apart intervals along the length of the winch line 22 extending below the plane. Each cannister 24 has an outfeed nozzle 26 releasably closed by a valve 28 operated by a solenoid 30 which is connected by wiring 32 to a computer 50 in the plane. The computer, using a special software program, controls the opening and closing of each of the valves, as will be described later.

Figure 4:
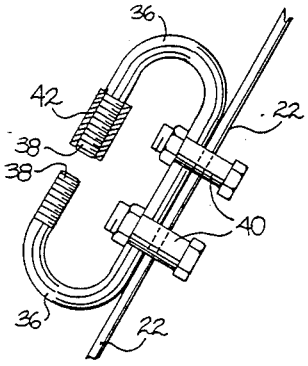
FIG. 4 is a fragmentary side elevation of a quick disconnect coupler arranged to releasably mount a canister to intermediate portions of the supporting winch line.
Figure 3:
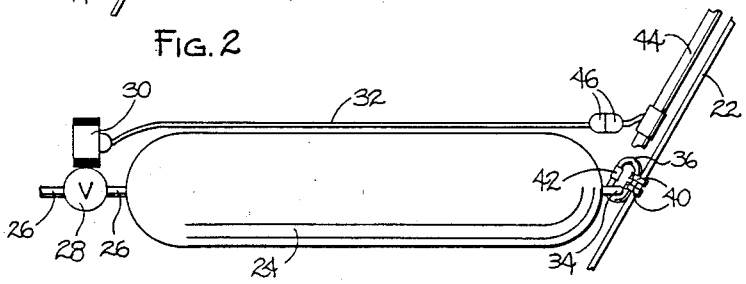
FIG. 3 is a fragmentary side elevation of one fogging chemical-containing canister attached with a quick disconnect coupler to an intermediate portion of the supporting winch cable, the canister mounting a remote control solenoid valve at its outlet nozzle end and a wiring harness connecting the valve solenoid to an onboard computer.

As shown in FIGS. 3 and 4, means is provided for releasably attaching the canisters to the winch line so that they are allowed to trail freely therebehind. As shown in FIG. 3, each canister includes on its closed, forward end an eyelet 34. In FIG. 4 connecter means, illustrated herein as a C-shaped loop 36 having threaded ends 38 is fastened to line 22 by means of a pair of split clamp bolts 40. An internally threaded sleeve 42 releasably intercepts the open, confronting threaded ends 38 of the C-shaped connector loop 36. Turning the sleeve in one direction threads the sleeve along one leg of the loop and partially onto the opposing leg, thus intercepting the opening therebetween. Turning the sleeve in the opposite direction opens the loop again.

As seen in FIG. 3, the eyelet 34 of the canister is inserted between the open confronting legs of the loop 36 and then the sleeve 42 is threaded to close the opening. Thus, very simple means may be provided to secure each canister to the line 22.

Also shown in FIG. 3, a multi conductor wire cable 44 extends along the winch line 22 and individual control wires 32 are releasably attached to corresponding wires in the cable 44 by suitable, conventional wire couplers 46. The rest of the canisters, seven all together shown in FIG. 1, includes similar fixtures as just described.

Having thus described the components of the present invention, reference is again now made to FIG. 1 of the drawings. As seen, the airplane 10 traveling at a constant altitude and speed preferably at approximately 60 miles per hour, carries, in this case, seven equally spaced apart chemical filled canisters 24 suspended on the winch line 22. The winch line, being subjected to the resistance from the air and wind, assumes the rearwardly angled position shown in FIG. 1. The wind also causes the canisters themselves to pivot on their eyelets 34 about the axis of the connectors 36 to a substantially horizontal position. The printing shown in FIG. 1 is illustrative of a five by seven matrix system, which will now be described.

As shown in FIG. 1, sky typing by this apparatus comprises a plurality of puffs 48 of smoke properly positioned so that together they form individual legs of letters and/or graphic designs. Each of the letters shown require five vertical columns for widths, and seven horizontal columns of height, the individual puffs of smoke being disposed at the intersection of appropriate horizontal and vertical axes of the matrix. The number of horizontal columns of course coincides with the number and disposition of the fog emitting canisters positioned along the winch line.

Identifying each of the canisters with a number 1 through 7, begining with the uppermost cylinder, the formation of the letter "S" (FIG. 1) for example involves the following sequence: Beginning at the left, the first vertical column of the five column wide letter requires activation of canisters 2, 3, and 6. In the second vertical column the canisters 1, 4 and 7 were fired as with the vertical columns 2, 3 and 4. Finally the fifth vertical column required firing of canisters 2, 5 and 6. With a plane travelling approximately 60 miles per hour, the letter thus formed in the five by seven matrix takes approximately two seconds. A one second time interval is involved between letters. The word "sky" shown in FIG. 1 thus would have taken approximately seven to eight seconds by an airplane flying in a single level flight at about 60 miles per hour.

The apparatus illustrated in FIG. 1 is scaled to show sky typing apparatus which prints letters that are 250 feet in height. Thus, the spacing between each of the canisters along the winch line is 42 ½ feet. It is to be understood however, that with a larger plane capable of handling a longer, heavier typing apparatus, letters of 1000 feet in height may similarly be produced. Other dimensions also may be accommodated.

The sky typing apparatus of this invention preferably utilizes my discovery of how to eliminate the inherent clogging of the canister nozzles when the fogging material being used is titanium tetrachloride. As previously mentioned, titanium tetrachloride is a very desirable fogging agent because of its extremely white oxide that produces highly visible lettering. Typical in the sky writing art, canisters carrying the chemical are charged with compressed air as the propellent used to expel the material into the atmosphere, whereupon it reacts with the moisture in the air. However, the oxide inherently begins to form in the nozzle itself, resulting in the nozzles becoming plugged as they are used.

Many alternative propellents have been tried in attempts to overcome this problem, and I have discovered that the problem is virtually eliminated by using a propellant which has a boiling point ranging between about −100 degrees F. and +50 degrees F. This range includes such propellents as carbon dioxide, propane, monochlorodifluoromethane, ammonia, dichlorodifluoromethane, methylchloride, perfluorocyclobutane, isobutane, sulphur dioxide, butane, dichlorotetrafluorethane and dichlormonofluoromethane. These may be used singly or in desired combinations. The preferred propellant is dichlorodifluoromethane (Freon R-12), for its mid range boiling point, its commercial availability and economy.

Mixtures containing about equal percentages by volume of titanium tetrachloride and propellant are satisfactory; greater percentages of titanium tetrachloride are wasteful. Mixtures containing about 25 percent volume of titanium tetrachloride and about 75 percent by volume propellant also are satisfactory; lesser amounts of titanium tetrachloride do not provide sufficient "smoke" for most purposes. A preferred mixture is approximately 40 percent by volume titanium tetrachloride and 60 percent by volume Freon 12. All of these mixtures keep the nozzles and valves completely clear while not adversely affecting the formation of smoke in the atmosphere.

In this regard, it will be recognized that no more than about 10 percent by volume of any of the aforementioned propellants would be sufficient merely to expel the titanium tetrachloride from the canister nozzle. However, it has been found that at least about 50% by volume of propellant is needed to prevent plugging of the nozzles and to achieve desired atomization of the mixture. Further, it appears that the propellants within the aforementioned boiling point range enhance the hydrolysis reaction of titanium tetrachloride and the moisture in the atmoshpere. With an airplane equipped with the sky typing apparatus described above being airborne, the operation of the sky typing apparatus is as follows: First, the canisters are attached to the winch line cable as the latter is paid out from the drum 18, by securing the canister eyelets 34 to respective couplers 36 previously anchored at desired spaced apart positions along the winch line. As the canisters are connected and secured to the couplers, the respective solenoid wirings 32 are connected to the appropriate matching wires carried in control cable 44 connected to the computer inside the airplane.

The computer program takes into account variables that effect the proper timing of the opening of the various solenoid valves 28 associated with each canister. Differences in air speed, the resulting differences in the angular disposition of the canister-supporting tow line 22 being dragged through the air, the desired widths and slopes of the lettering to be formed, and other factors are a few of these variables which can be accommodated in the memory of the computer.

For example, an advertising slogan comprising a series of words may be typed into the computer using the computer keyboard. The computer then automatically plots the various letters out using the aforementioned matrix system or a different matrix if desired. When the airplane is in proper position, the program is run and electrical impulses are sent from the computer to canister solenoid valves in proper sequence to direct the dispensing of the fog material therefrom by selective activation of the solenoid valves associated therewith.

The airplane continues to fly its course through the air until the computer has run its program and completed the advertising sky typing. For designs, using the same, or a different matrix system, the operator may instruct the computer which insecting points on the matrix he wants a particular canister to fire, in order to form a part of a desired design. This is done in the same manner that is typical in computer graphics.

Using an airplane capable of supporting a number of spaced apart, canister supporting winch lines extending laterally across the plane, or by one plane making a number of passes adjacent sky typing already done, three dimensional art work may be done in the sky. Also, the height of the lettering is restricted only by the plane's ability to support the weight and resulting drag of a longer winch line and larger or more canisters attached thereto. The width of the lettering, as previously mentioned, is controlled strictly by the timing that the computer provides between successive puffs of smoke.

Also, different styles of printing may be provided simply by instructing the computer to print in italics, for example, and the computer will simply adjust the angle of the lettering by making suitable variations in the particular firing timing of the solenoid valves.

From the foregoing, it will be apparent that the sky typing apparatus of this invention introduces into the art an entirely new method of printing letters and designs in the sky. Aside from the extremely high costs involved in sky typing of the prior art, a wrongly placed or timed firing of smoke from one of the planes of the team can instantly destroy the work previously done by the team of artists. Using the method and apparatus of this invention, the operator simply types into the computer the message or design desired, sees exactly what is to be sky typed displayed on the screen of the computer, can make corrections as he deems fit, and finally, what is actually printed in the sky will be precisely what was displayed to him previously on his computer monitor.

It will be apparent that various changes, other than those already described may be made in the size, shape, type, number, and arrangement of parts described hereinbefore without departing from the spirit of this invention and scope of the appended claims. For example, a single, large chemical containing canister could, if desired, be carried within the airplane itself, and pressurized lines provided to connect the canister to the desired number of spaced apart nozzles disposed along the length of the winch line. Individual solenoid control valves would be provided on each nozzle as shown, connected to the computer in the same manner as has been described. This would eliminate the use of the plurality of separate chemical containing canisters, the effort required in their connection and disconnection and storage, and part of the weight and drag or the winch line itself.

Having thus described my invention and the manner in which it may be used, I claim:

1. Sky typing apparatus for attachment to an airplane, comprising:

(a) an elongated support line arranged to be suspended from an airplane when in flight, (b) a plurality of fog dispensing nozzles each having an infeed end and secured in spaced apart relation along said support line, (c) electric solenoid valve means associated with each dispensing nozzle for opening and closing the nozzle, (d) container-confined fog producing material under pressure connected to the infeed end of each nozzle, and (e) control means connected to said valve means for selectively controlling the opening and closing of the dispensing nozzles in a predetermined sequence, the control means including a computer in the airplane capable of being programmed to provide electric output signals to control activation of the electric solenoid valve means according to airplane speed to produce a predetermined printing in the sky.

2. The sky typing apparatus of claim 1 wherein said container-confined fog producing material comprises a mixture of about 25–50% by volume titanium tetrachloride and about 75–50% by volume of a propellant of at least one of the substances selected from the class consisting of carbon dioxide, propane, monochlorodifluoromethane, ammonia, dichlorodifluoromethane, methylchloride, perfluorocyclobutane, isobutane, sulphur dioxide, butane, dichlorotetrafluoroethane and dichloromonofluoromethane.

3. The sky typing apparatus of claim 1 wherein the fog producing material is contained in a plurality of individually pressurized canisters one associated with each dispensing nozzle.

4. The sky typing apparatus of claim 2 wherein the fog producing material mixture is contained in a plurality of individually pressurized cannisters attached at spaced apart intervals along said elongated support line, one cannister associated with each dispensing nozzle.

5. A method of sky typing utilizing only one airplane to accomplish the printing of letters, numbers, words, designs and like indicia in the sky, the sky typing method comprising:

(a) suspending a plurality of vertically spaced fog emitting nozzles from an airplane as it travels through the sky, and (b) selectively emitting fog producing material from the vertically spaced nozzles in a predetermined sequence to form individual portions of indicia, the individual portions combining to form complete indicia, and (c) adjusting the predetermined sequence of emission of fog producing material from each individual nozzle according to variations in airplane speed, wind and other factors which affect the proper positioning of the individual indicia portions for combining with other portions to form complete indicia.

6. The method of claim 5 wherein the fog producing material is selectively emitted on command by a computer operating on a predetermined program making suitable changes in a predetermined timing sequence according to variations in airplane speed, wind and other factors present as the plane is in flight.

7. The method of claim 5 including providing fog producing material under pressure in individual canisters, one canister associated with each fog emitting nozzle.

* * * * *